US009086257B2

(12) United States Patent
Laporte et al.

(10) Patent No.: US 9,086,257 B2
(45) Date of Patent: Jul. 21, 2015

(54) TARGET LAUNCHING DEVICE

(75) Inventors: Jean-Michel Laporte, Biot (FR); Jean-Marc Fouques, Claviers (FR)

(73) Assignee: LAPORTE HOLDING, Biot (FR)

( * ) Notice: Subject to any disclaimer, the term of this patent is extended or adjusted under 35 U.S.C. 154(b) by 142 days.

(21) Appl. No.: 13/696,288

(22) PCT Filed: May 3, 2011

(86) PCT No.: PCT/EP2011/057077

§ 371 (c)(1), (2), (4) Date: Jan. 30, 2013

(87) PCT Pub. No.: WO2011/138343

PCT Pub. Date: Nov. 10, 2011

(65) Prior Publication Data

US 2013/0118467 A1 May 16, 2013

(30) Foreign Application Priority Data

May 5, 2010 (FR) ..... 10 53485

(51) Int. Cl.

| | |
|---|---|
| ***F41J 9/18*** | (2006.01) |
| ***F41J 9/00*** | (2006.01) |
| ***F41J 9/32*** | (2006.01) |
| ***A63B 69/40*** | (2006.01) |
| ***F41J 9/16*** | (2006.01) |
| ***F41J 9/20*** | (2006.01) |
| ***F41J 9/24*** | (2006.01) |
| ***F41J 9/30*** | (2006.01) |

(52) U.S. Cl.

CPC . *F41J 9/18* (2013.01); *A63B 69/40* (2013.01); *F41J 9/16* (2013.01); *F41J 9/20* (2013.01); *F41J 9/24* (2013.01); *F41J 9/30* (2013.01); *A63B 2069/402* (2013.01)

(58) Field of Classification Search

CPC ..... F41J 9/18; F41J 9/32; A63B 69/40; A63B 2069/402

USPC ..... 124/6, 8, 9, 26, 81

See application file for complete search history.

(56) References Cited

U.S. PATENT DOCUMENTS

| | | | | | |
|---|---|---|---|---|---|
| 488,827 | A | * | 12/1892 | Melius | 124/16 |
| 1,374,757 | A | * | 4/1921 | Napier | 124/26 |
| 1,552,191 | A | * | 9/1925 | Bahlmann | 124/26 |
| 1,638,283 | A | * | 8/1927 | Bahlmann | 124/26 |
| 2,135,603 | A | * | 11/1938 | Roth | 124/8 |

(Continued)

FOREIGN PATENT DOCUMENTS

DE 202004013738 12/2004

OTHER PUBLICATIONS

English translation of European Patent Office Written Opinion for International Patent Application No. PCT/EP2011/057077, Filed May 3, 2011, Applicant, Laporte Holding (5 pages).

(Continued)

*Primary Examiner* — Melba Bumgarner
*Assistant Examiner* — Alexander Niconovich
(74) *Attorney, Agent, or Firm* — McCracken & Gillen LLC

(57) ABSTRACT

Device for launching targets comprising a surface supporting a target to be launched and a launch arm capable of applying a launch force to the target, characterized in that the supporting surface includes frictional means for rotating the target when it is launched by the launch arm. Application in particular to launching archery targets.

16 Claims, 6 Drawing Sheets

(56) References Cited

U.S. PATENT DOCUMENTS

| | | | | | |
|---|---|---|---|---|---|
| 2,934,056 | A | * | 4/1960 | Lauterbach | 124/9 |
| 3,368,542 | A | * | 2/1968 | Dale | 124/8 |
| 3,417,741 | A | * | 12/1968 | Schreiner | 124/8 |
| 3,420,218 | A | * | 1/1969 | Rademacher | 124/7 |
| 3,598,099 | A | * | 8/1971 | Luebkeman | 124/43 |
| 3,601,112 | A | * | 8/1971 | Dale | 124/8 |
| 4,122,822 | A | * | 10/1978 | Scheiwiller | 124/54 |
| 4,220,130 | A | * | 9/1980 | Glover et al. | 124/7 |
| 4,365,612 | A | * | 12/1982 | Defosse | 124/54 |
| 4,481,932 | A | * | 11/1984 | Olson | 124/8 |
| 5,050,575 | A | * | 9/1991 | Killion | 124/8 |
| 5,261,674 | A | * | 11/1993 | Allison | 273/359 |
| 5,465,978 | A | * | 11/1995 | Magnone et al. | 124/7 |
| 5,720,664 | A | * | 2/1998 | Brubacher | 463/52 |
| 5,911,214 | A | * | 6/1999 | Andrews | 124/16 |
| 6,176,229 | B1 | * | 1/2001 | Patenaude | 124/8 |
| 6,715,477 | B1 | * | 4/2004 | Gilman | 124/16 |
| 7,263,986 | B2 | * | 9/2007 | Lovell | 124/9 |
| 2012/0138034 | A1 | * | 6/2012 | Whidborne | 124/8 |

OTHER PUBLICATIONS

International Search Report from the European Patent Office dated Jun. 29, 2011, for International Patent Application No. PCT/EP2011/057077, Filed May 3, 2011, Applicant, Laporte Holding. (2 pages).

European Patent Office Written Opinion for International Patent Application No. PCT/EP2011/057077, Filed May 3, 2011, Applicant, Laporte Holding (5 pages).

* cited by examiner

Figure 1
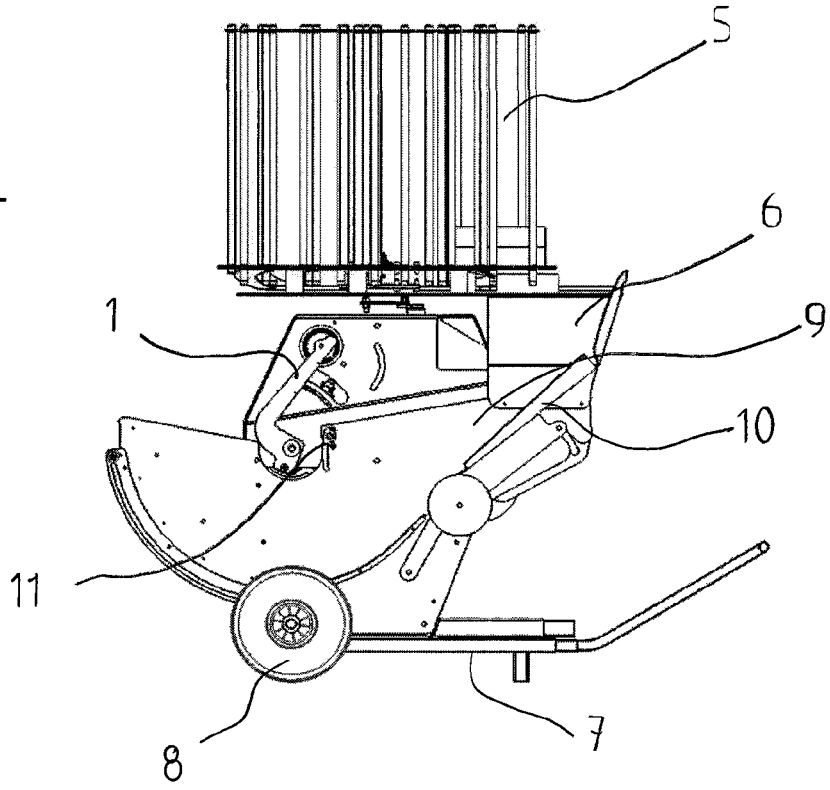
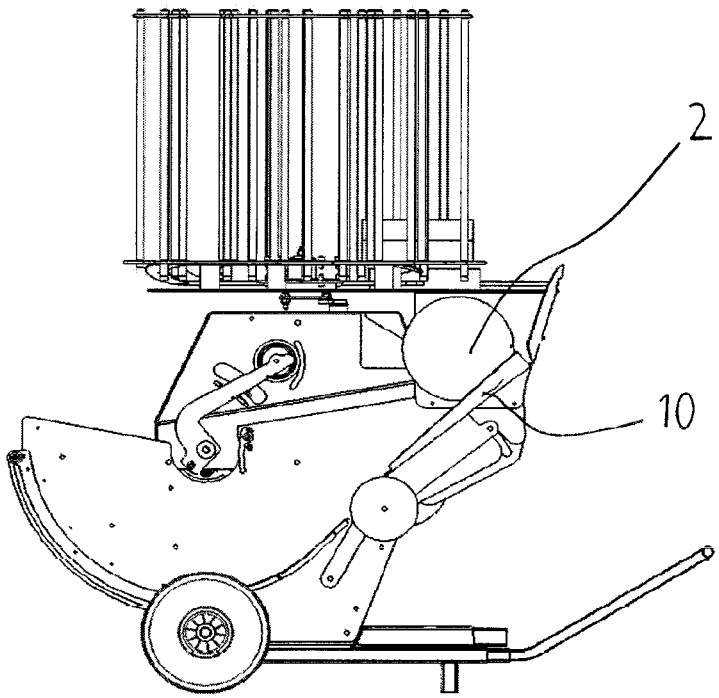
Figure 2

TARGET LAUNCHING DEVICE

The present invention relates to a device for launching targets, particularly targets of the clay pigeon type or for archery.

This latter activity has only developed recently and offers archers the opportunity to test their accuracy skills, essentially on stationary targets. There are other devices for launching targets that are particularly suitable for launching day pigeon type targets. These devices generally include a rotary arm for launching a target. The target is placed on a substantially horizontal plate prior to its launch.

Document U.S. Pat. No. 1,638,283 discloses an apparatus for launching targets comprising a track on which the target is installed on its rim. This track is made of a material with a high coefficient of friction and an arm formed by an elongate rod aligned with the track and used to launch the target.

Document U.S. Pat. No. 1,552,191 describes a device that is substantially identical to that described in document U.S. Pat. No. 1,638,283.

There is currently a need to improve the interaction between the launch zone of the device and the target.

The present invention overcomes all or part of the disadvantages of the techniques known at present in target launching.

In particular, one purpose of the invention is to develop a device for launching targets having a launch area improved by a specific contact between the target and a supporting surface, so as to ensure rotation of the target before launching. The applicant has observed that the target will adopt a better trajectory on leaving the machine if rotating, especially at high frequency. In particular, rotation stabilizes the target's movement through the air. The target trajectory is less sensitive to the wind, smoother and can be reproduced from one launch to another; this is particularly advantageous for both practicing and competition.

Other aims and advantages will become apparent from the following description of a preferred embodiment of the invention, which is not limiting.

Before proceeding to this detailed description, it should be remembered that the invention concerns a device for launching targets with circular section, the device comprising a surface supporting a target to be launched and a launch arm capable of applying a launch force to the target. The apparatus is characterized in that the supporting surface has friction means for rotating the target when launched by the launch arm.

According to one aspect of the invention, that may or may not be combined with friction means, the launch arm has advantageously a pushing surface that applies a force to the target. This consists of the outer surface of a freely rotating roller.

Below are the advantageous embodiments that may be combined or executed as an alternative and do not limit the invention:

- the friction means include holes created on at least one zone of the supporting surface
- the holes are slot shaped
- the slots are arranged approximately parallel across the width of the supporting surface
- the friction means include reliefs created on at least one zone of the supporting surface
- the reliefs include multiple bumps
- at least some of the bumps have a hole at their top
- the reliefs include an agglomerate of particles embedded in a layer of binder
- the particles include mineral particles

- the particles include silicon carbide particles
- the reliefs have at least one section roughened by machining the supporting surface
- the launch arm is rotary and the supporting surface has a concave longitudinal profile in a plane parallel to the rotational plane of the launch arm
- the longitudinal profile is an arc of circle
- the arc of circle is centred on the axis of rotation of the launch arm
- it consists of at least one cylindrical and circular section target, the edge of which is configured so as to bear on the supporting surface
- the target is made of plastic
- the launch arm has a surface that applies a push to the target; this surface consisting of the outer edge of a freely rotating roller
- the launch arm is configured so that the push surface is in contact with a part of the target at a distance from the push surface of more than one radius of the circular section of the target The accompanying drawings are given as examples and do not limit the invention. They represent only one embodiment of the invention and will enable it to be easily understood.

FIG. 1 shows a partial longitudinal section of the launch device in a preferred embodiment.

FIGS. 2 and 3 show similar views at the target loading phases.

Figure 3:
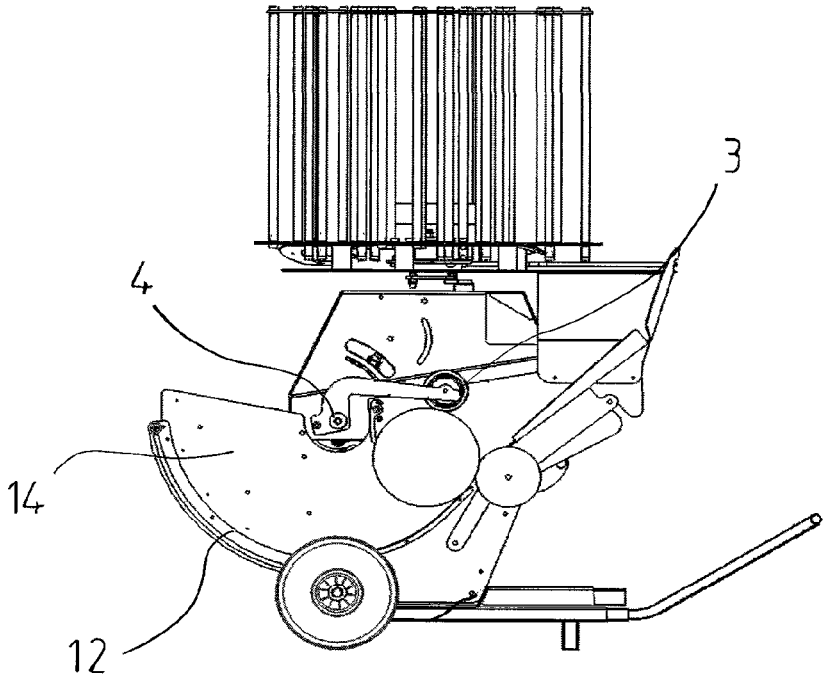

With reference to FIG. 1, it will be noted that the invention device may include a base 7 that can be a welded metal structure, although this is only one possibility for illustrative purposes, and can be equipped with gripping means such as a handle and wheel 8. A launching assembly, mainly consisting of a launch arm 1 assembled in a preferred arrangement so as to rotate on an axis of rotation 4 is assembled on the base. In the example shown, the axis of rotation 4 is substantially horizontal. Conventional actuating means may be used to apply a rotational force to launch arm 1. Thus, the launch arm 1 is able to coact with a spring that is tightened by a motor, and may be released on order to launch the target 2.

The latter, although this is not restrictive, is advantageously a target of the type consisting of a substantially cylindrical plate made of a plastic material and more especially one or several layers of a polymer foam. The preferred circular shape of the target 2 enables it to roll on a supporting surface such as described in detail below. The target consists of at least one part with circular section.

Above the launch area is a cylinder 5 which, in the example shown, allows successive loading and launching of the targets 2. As is known on clay pigeon devices, the cylinder 5 shown comprises of several parallel rods defining substantially cylindrical volumes for receiving the superimposed targets 2. The cylinder 5 is driven rotationally by separate means or coupled with means driving the launch arm so that when it is required to launch a target, the cylinder 5 is actuated rotationally in order to cause a target 2 to be delivered in the direction of the launch zone close to the arm 1. Thus, in the case shown in FIG. 1, the cylinder 5 is positioned on top of an inclined ramp 6 in order to deliver a target from the cylinder 5 to the loading zone 9 where the target 2 is able to descend along a chute 10 up to a stop 11 which prevents its further descent.

It will be easily understood that at this stage the launch arm 1 is able to be actuated so as to launch the target 2 thus positioned. In the example shown, the launch arm 1 has at its distal end a miler 3 of substantially circular section and preferably mounted to pivot relative to the remainder of the launch arm 1 so as to bear on the target while retaining a rotational freedom of movement of its own.

According to the invention, a supporting surface 12 is provided in order to accompany the launch movement of the target 2. To this end, the supporting surface 12 is positioned below the launch arm 1 and is configured so as to receive a target 2 standing on its rim. The supporting surface 12 has a longitudinal profile (that is to say, oriented in the same direction as the views in FIGS. 1 to 9), in a plane transversal to the axis of rotation 4 of the launch arm. The concave longitudinal profile has a cradle-like shape so as to accommodate the target 2 and guide it smoothly through the launch movement. The supporting surface is preferably an arc of circle. Moreover, in order to maintain a constant distance between the distal end of the launch arm 1 and the supporting surface 12, the arc of circle in question is preferably centred on the axis of rotation 4. This is given as an example. In particular, if it is required to vary the rotational effects of the target, the arc of circle can be off-centred.

The width of the supporting surface 12 is not limited but is preferably equal to or slightly greater than the thickness of the rim of the target 2.

The supporting surface 12 may be formed of one or more parts and be made of various materials, but has to be sufficiently rigid to ensure that the supporting surface 12 does not deform under the effect of the force created by the target 2. For example, a metal plate or rigid plastic parts may be used for the supporting surface 12.

The supporting surface 12 also includes means for applying friction. The device is thus configured so that the coefficient of friction of the supporting surface 12 relative to the target 2 is greater than that of a flat metal plate or a smooth plastic surface.

The friction means include advantageously reliefs formed or added onto the supporting surface 12.

The reliefs may be of different types installed alternately or in combinations. Furthermore, the reliefs need not be present over the entire length of the supporting surface.

One possibility is that the reliefs take the form of bumps projecting from the supporting surface 12 towards the target. The bumps may be executed by stamping the surface of one or several pieces of sheet metal. Their base diameter is, for instance, between 8 millimeters and 20 millimeters. They may be in a staggered arrangement as in FIG. 10 with, in this case, one or two bumps across the width of the supporting surface.

Figure 11:
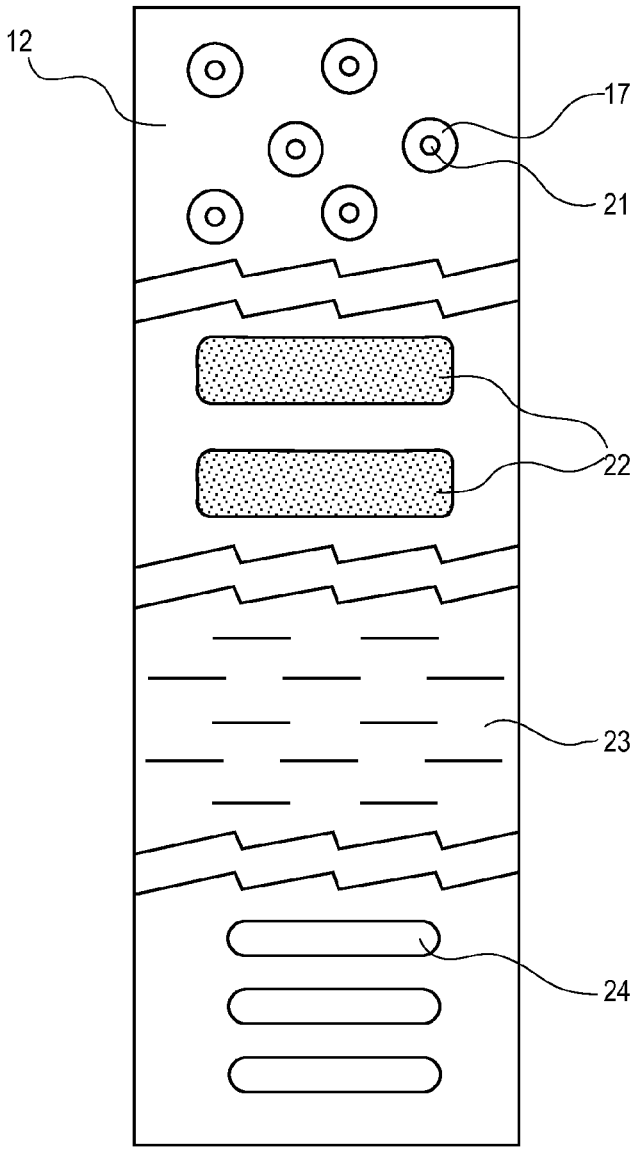
FIG. 11 is a plan view of the supporting surface having reliefs.

As shown in FIG. 11, the bumps 17 may include a hole 21 at their top created by cutting into a metal sheet. The bumps 17, whether or not perforated, thus form discontinuities on the surface of the supporting surface 12 so as to increase the adherence of the rim of the target 2.

According to another arrangement, the reliefs may be formed by one or more strips 22 of non-slip material as shown in FIG. 11. Thus, an agglomerate of particles embedded in a hinder (such as a polymer matrix or another resin) may be laid on the supporting surface 12 or added in the form of strip(s) 22 to be bonded onto a surface.

Moreover, a rough surface 23 can be created by treating the supporting surface 12. In particular, this may consist in sand blasting or another method of degrading, roughening or scratching the supporting surface 12.

Below is a description of an advantageous embodiment of the supporting surface 12 in two parts that enables the target launch angle to be adjusted. This example in no way limits the invention. As shown in the various FIGS. 1 to 9, the apparatus comprises a base part 13 having a side 14 oriented substantially perpendicular to the supporting surface 12 so as to form a boundary limiting the deflection of the target 2 on the supporting surface 12. In addition, the base part 13 constitutes a first section of the supporting surface 12. Advantageously, said first section is located upstream of a second section in the direction of rotation of the launch arm when in the launch phase. Thus, the first section formed in the base part 13 constitutes the first supporting component which receives the target 2 during launching. The support continues with a second section formed in another part, for example a flap 15 in this case. The illustrated flap 15 includes a part of the side 16 oriented so as to be positioned opposite the side 14 of the base part 13 so as to constitute a boundary limiting the movement of the target 2 by means of the face of the target 2 opposing the face opposite the side 14. In addition, the flap 15 includes the second section that contributes to creating the supporting surface 12.

In the case shown, the flap 15 is able to move in rotation relative to the base part 13 which, in the example, is fixed relative to the base 7 of the launch device. The rotational movement ensures that the relative position of the flap 15 and the base part 13 can be adjusted. More specifically, these two constituent parts of the device may be fitted together with a variable range of rotation so as to change their overlap at the supporting surface 12. In other words, the supporting surface 12 can be shortened by moving the flap 15 and superposing a part of the second section (preferably by passing it under the first part of the supporting surface 12) so as to overlap the base part 13. By changing the overlapping surface of the two sections of the supporting surface, the configuration and the target exit angle are altered.

All the flap 15 rotational adjustment means are part of the invention. For example, the flap 15 is fitted to pivot around an axis advantageously parallel and even identical to the axis of rotation 4 of the launch arm 1. In addition, means are provided for stopping the rotation of the flap 15 so as to render it immobile when reaching the required angular position of the flap 15.

Figure 10:
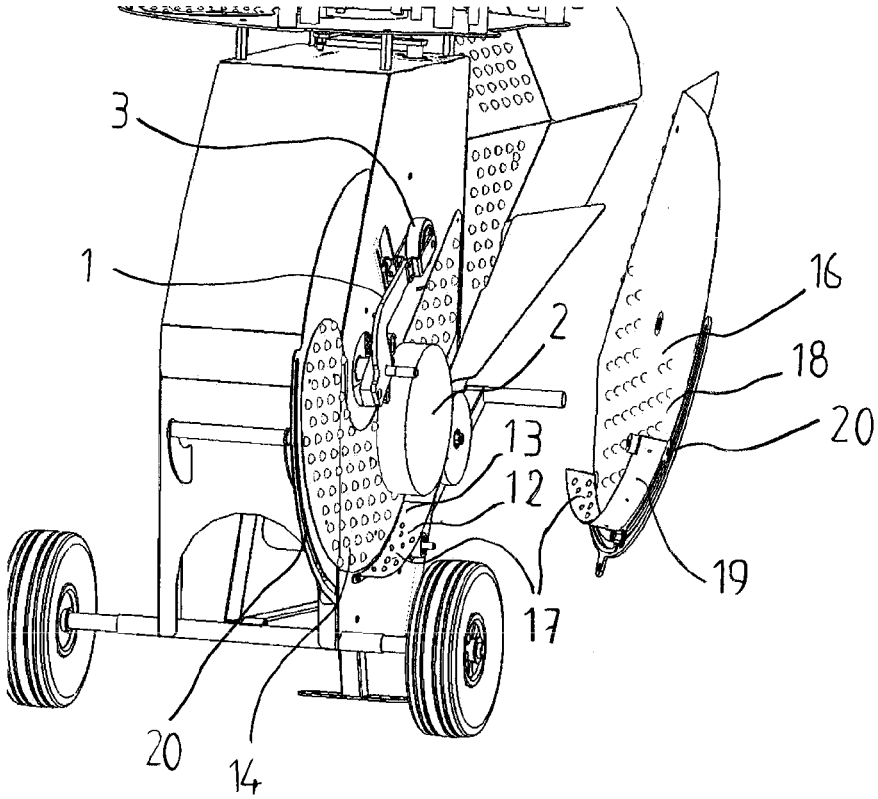
FIG. 10 is a partial perspective view according to another embodiment of a device which also shows the supporting surface here in two different parts.

FIG. 10 shows a variation of an adjustment of the supporting surface 12 with a section formed as above on the side of a base part 13 and a section formed on a side wall 18 fixed on the remainder of the machine and a section 19 whose angular position is adjustable in a slide forming an arc of circle. The side wall also forms advantageously a side that is able to come into contact with one face of the target.

Figure 4:
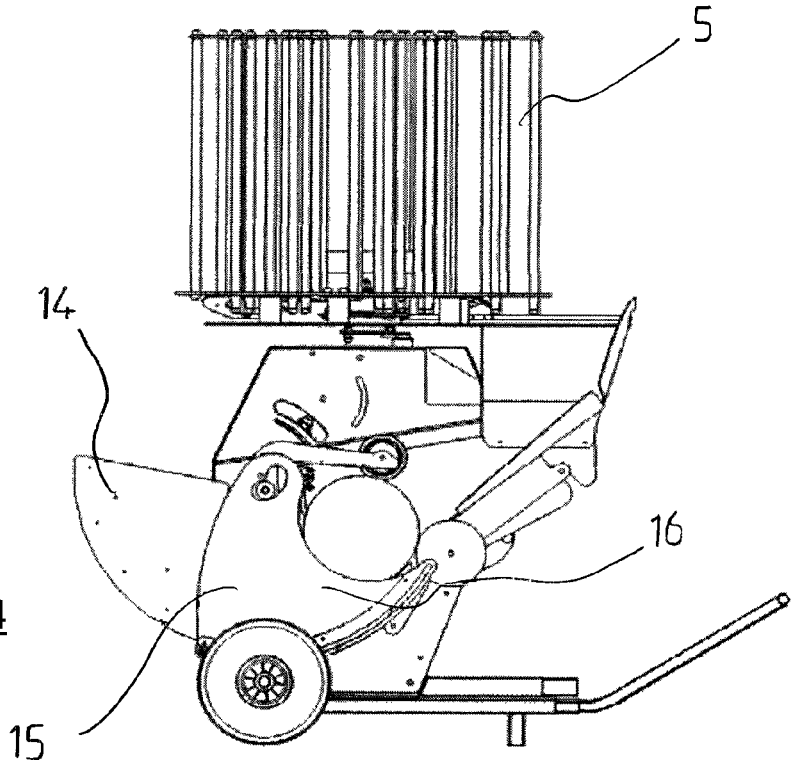
FIGS. 4 and 5 show two side views of the device, a flap for adjusting the bearing surface of the target is in a first position.
Figure 5:
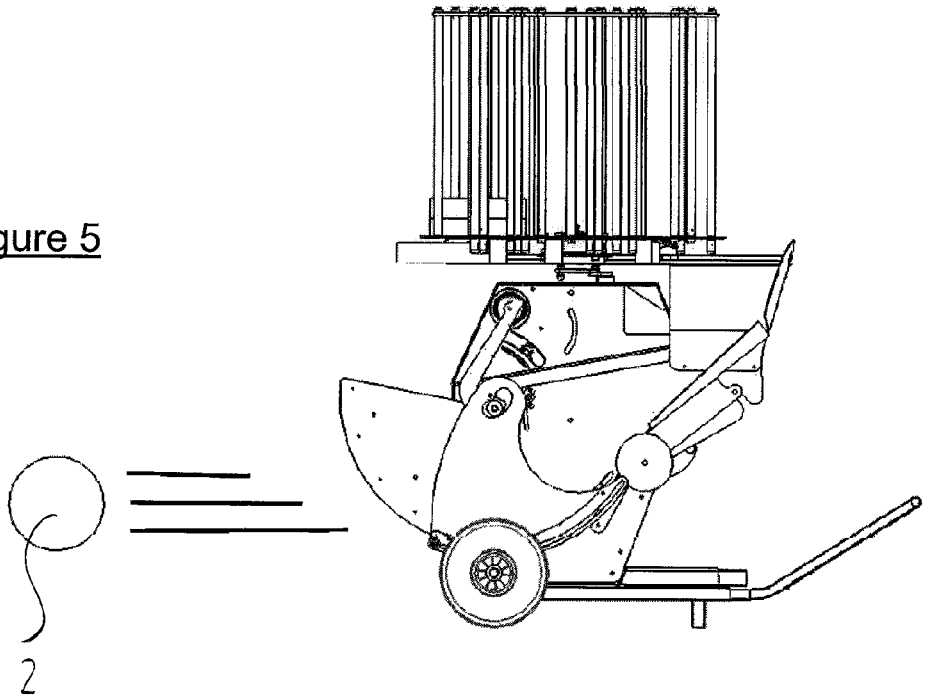

FIG. 4 shows the angular position of the flap 15 in which the latter is essentially folded around the base part 13 so that the first and second sections of the supporting surface largely overlap. In these conditions, when receiving the target 2, the active supporting surface 12 essentially consists of the first section situated on the base part 13. This reduces the arc of circle of the supporting surface and the target 2 is launched, as shown in FIG. 5, in a substantially horizontal direction, it being stated here that the illustrated embodiment ensures that the downstream end of the first section of the supporting surface 12 on the base part 13 is substantially opposite the launching arm 1 when in a vertical position, or so that the tangent to the arc of circle at the downstream end is substantially horizontal. In this way, the target 2 is launched substantially horizontally.

Figure 6:
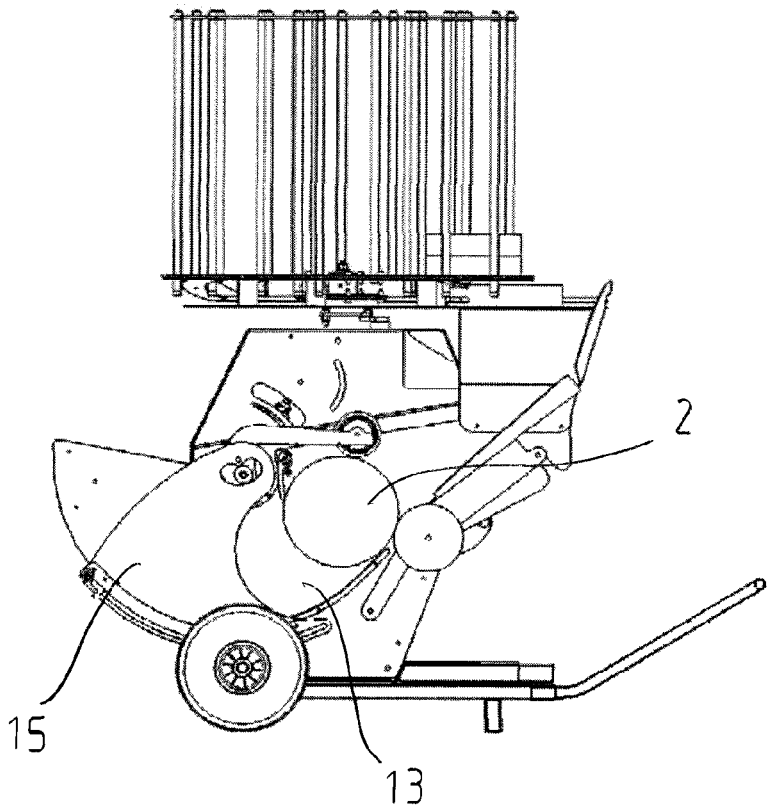
FIGS. 6 and 7 show in a similar side view of the device with the flap in a second position.
Figure 7:
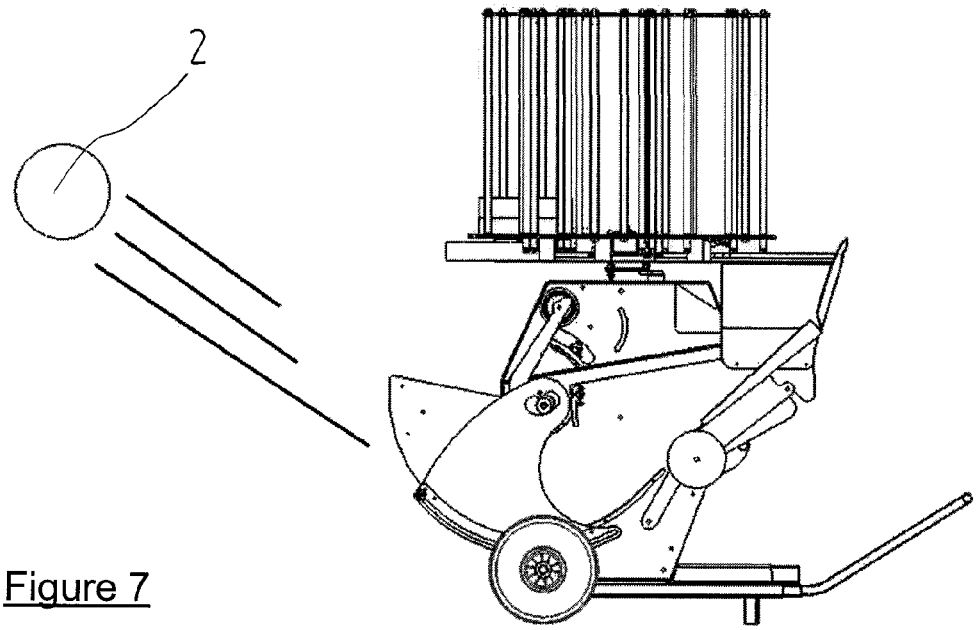

FIG. 6 shows another possible position of the flap 15, turned slightly clockwise so as to increase the supporting surface 12. It will be understood that, since the supporting surface is increased by the second section located on the flap 15, the target 2 is supported longer on the supporting surface 12. Thus, this changes the launch direction as shown in FIG. 7.

Figure 8:
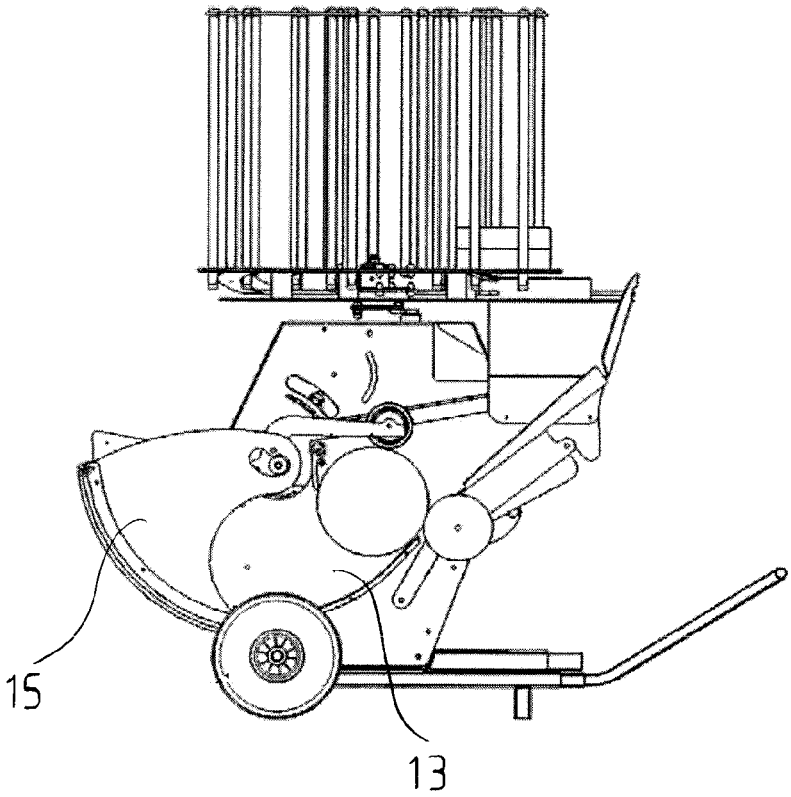
FIGS. 8 and 9 show corresponding views with a flap in a third position.
Figure 9:
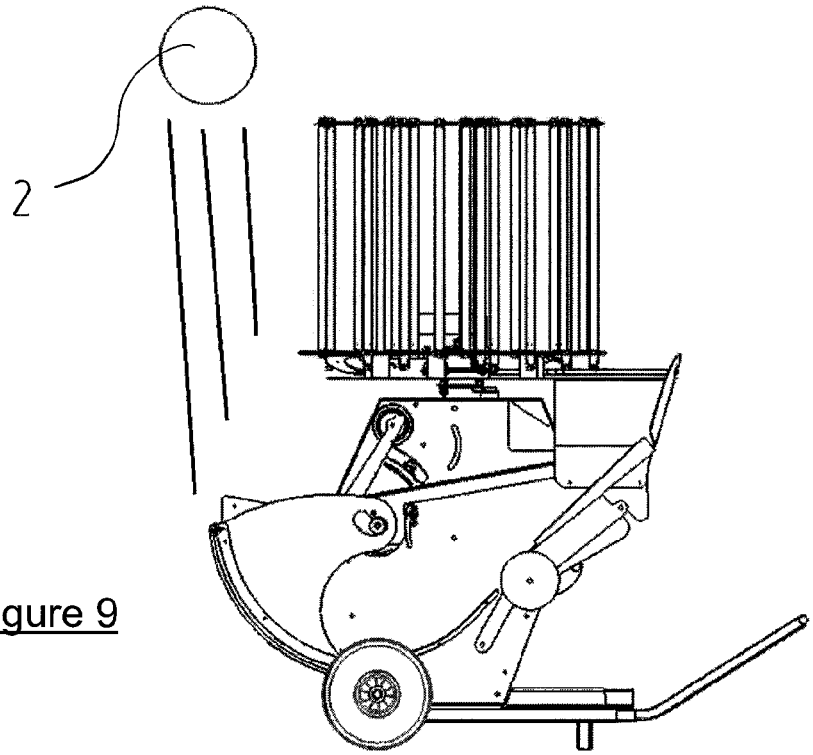

A third example of the relative position of the flap 15 and the base part 13 is shown in FIG. 8 with a flap 15 still raised in a clockwise rotational direction. In this configuration, the arc of circle of supporting surface forms a sector of around 140° to 170° along which the target 2 is supported. Due to the orientation of the flap 15, the launch direction of the target 2 is substantially more vertical as shown in FIG. 9.

The variation range of supporting surface 12 according to the invention is not limited. Advantageously, the launch direction of the target 2 (i.e., the direction of the tangent to the arc of circle of the supporting surface at the downstream end thereof) may vary between the horizontal and the vertical, i.e. in a range of around 90°. It will be to understood that this range can cover a large number of possible launches for practicing gun shooters and archers in particular.

It will also be noted that the flap 15 is a part that remains attached to the rest of the device and can be easily adjusted. Thus, the user does not require a long time or have to perform complex manipulations in order to change the orientation.

The variant in FIG. 10 allows the same operation for the section 19, as for the flap 15.

It will be noted that the adjustment control for the flap 15 (or the section 19) may be motorized in order to automate the entire control assembly of the device. Nevertheless, both the adjustment of the flap 15 (or the section 19) or the target loading and launching phases can be carried out entirely manually.

Advantageously, all or part of the surfaces that come into contact with the sides of the target 2 (that is to say its circular side was in the case of a flattened cylindrical target) have means for reducing the adhesion and the friction of the target 2. The surfaces involved are in particular the surfaces along which the target 2 travels from the cylinder 5 or the surfaces for laterally maintaining the target 2 at the level of the launch zone by the launch arm 1. It will be noted that by reducing the contact between the target 2 and the machine at this point, the force resisting the push of the arm and possibly the rotation of the target 2 itself are reduced.

The means reducing the adherence or the friction consist of points of discontinuous contact between the target 2 and the surface of the machine in question.

By way of preferred example, an embossed surface, wherein the summits of the cells are in contact with the target 2, gives satisfaction. Alternatively, rounded spikes such as the bumps 17 shown, or conical ones, may be used. More generally, all the relief formed so as to reduce the contact area with the target 2 falls within the scope of the invention.

Another embodiment consists in perforating the surface in contact with the target 2. Thus, cutouts or form of wires, notably steel wires, that can be mechanically welded to produce lines in contact with the target 2 can be formed on zones in which the contact will be limited.

In an advantageous arrangement, the holes 24 formed in the surface in contact with the target 2 are slot shaped, as shown in FIG. 11. Preferably, the slots 24 are arranged substantially parallel across the width of the supporting surface 12. The slots 24 are arranged transversely to the movement of the target 2 on the supporting surface 12. The slots 24 increase the friction between the target 2 and the supporting surface 12. It may consist of rectangular cut out holes, the long sides of which extend depending on the thickness of the target 2, that is to say the width of the supporting surface 12.

Advantageously, the arm 1 applies its force on the upper half of the target, that is to say, the contact of the arm 1 (through the roller 3 in the illustrated embodiment) and the rim of the target takes place at a distance from the supporting surface 12 that is greater than the radius of the circular section of the target 2. This positioning of the point of applying the force on the target 2 facilitates the application of the latter on the supporting surface, the arm 1 being configured so that its force is directed towards the supporting surface. The centrifugal force also contributes to increasing the contact of the target 2 on the supporting surface 12. The pressure of the target 2 of the supporting surface increases the grip and the rotational effect generated.

It will be noted that the use of a target in polymer foam gives a certain deformability at the periphery of the target, thereby increasing the contact surface.

REFERENCES

1. Launch arm
2. Target
3. Roller
4. Axis of rotation
5. Cylinder
6. Ramp
7. Base
8. Wheel
9. Loading zone
10. Chute
11. Stop
12. Supporting surface
13. Base part
14. Side
15. Hap
16. Side
17. Bumps
18. Side wall
19. Section
20. Slide

The invention claimed is:

1. A device for launching targets with circular section, having a surface supporting a circular rim of a target to be launched and a launch arm configured to apply a launch force to the target, wherein the launch arm comprises a pushing surface applying a launch force to the target and comprising an outer rim of a roller rotating freely on its own, the said roller being configured to contact the target;

wherein the launch arm is rotational and wherein the supporting surface has a concave longitudinal profile in a plane parallel to a rotational plane of the launch arm;

wherein the launch arm is configured so that the pushing surface applying the force is in contact with a region of the target located at a distance from the supporting surface of more than one radius of a circular section of the target throughout the concave longitudinal profile of the supporting surface, and wherein the supporting surface includes friction components for rotating the target when launched by the launch arm.

2. The device according to claim 1 wherein the friction components comprise openings on at least one zone of the supporting surface.

3. The device according to claim 2 wherein the openings are slot-shaped.

4. The device according to claim 3 wherein the slots are arranged substantially parallel across a width of the supporting surface.

5. The device according to claim 4 wherein the friction components comprise reliefs created on at least one zone of the supporting surface.

6. The device according to claim 5 wherein the reliefs comprise multiple bumps.

7. The device according to claim 6 wherein at least one part of the bumps have a summit and a hole at the summit.

8. The device according to claim 5 wherein the reliefs comprise an agglomerate of particles embedded in a layer of binder.

9. The device according to claim 8 wherein the particles comprise mineral particles.

10. The device according to claim 8 wherein the particles comprise silicon carbide particles.

11. The device according to claim 5 wherein the reliefs comprise at least one section roughened by machining the supporting surface.

12. The device according to claim 1 wherein the longitudinal profile is an arc of circle.

13. The device according to claim 12 wherein the arc of circle is centered on an axis of rotation of the launch arm.

14. The device according to claim 1 comprising at least one cylindrical target with circular section, a rim of which is configured so as to be applied to the supporting surface.

15. The device according to claim 14 wherein the target is made of plastic.

16. A device for launching targets with circular section, having a surface supporting a circular rim of a target to be launched throughout a launch movement, and a launch arm configured to apply a launch force to the target, wherein the launch arm comprises a pushing surface applying a launch force to the target;

wherein the launch arm is configured so that the pushing surface applying the force is in contact with a region of the target located at a distance from the supporting surface of more than one radius of a circular section of the target throughout the launch movement, and wherein the supporting surface includes friction components for rotating the target when launched by the launch arm.

* * * * *